US006922977B2

(12) United States Patent
Agostini et al.

(10) Patent No.: US 6,922,977 B2
(45) Date of Patent: Aug. 2, 2005

(54) ERGONOMIC BLISTER PACKAGING MACHINE

(75) Inventors: Mark Agostini, Roscoe, IL (US); Ronald Worden, Maple Park, IL (US); Tom Aidich, Sycamore, IL (US); Joe Minkwitz, Rockford, IL (US)

(73) Assignee: Alloyd Co,. Inc., Dekalb, IL (US)

( * ) Notice: Subject to any disclaimer, the term of this patent is extended or adjusted under 35 U.S.C. 154(b) by 10 days.

(21) Appl. No.: 10/607,236

(22) Filed: Jun. 26, 2003

(65) Prior Publication Data

US 2004/0261371 A1 Dec. 30, 2004

(51) Int. Cl.[7] ..... B65B 51/10

(52) U.S. Cl. ..... 53/467; 53/471; 53/478; 53/202; 53/250; 53/251; 53/389.1; 53/253; 53/282

(58) Field of Search ..... 53/467, 471, 478, 53/202, 250, 251, 329, 389.1, 253, 282; 414/222.09, 793, 795.4

(56) References Cited

U.S. PATENT DOCUMENTS

| | | | | |
|---|---|---|---|---|
| 3,195,284 A | * | 7/1965 | Crane, Jr. | 53/559 |
| 3,946,537 A | * | 3/1976 | Hair et al. | 53/329.3 |
| 5,329,750 A | * | 7/1994 | Bagley et al. | 53/389.1 |
| 5,379,572 A | | 1/1995 | Giovannone | |
| 5,404,693 A | | 4/1995 | Giovannone | |
| 5,522,505 A | | 6/1996 | Giovannone | |
| 5,600,939 A | | 2/1997 | Giovannone | |
| 5,623,816 A | * | 4/1997 | Edwards et al. | 53/478 |
| 6,604,342 B1 | * | 8/2003 | Appelbaum | 53/471 |

OTHER PUBLICATIONS

*Six–Station Blister Packaging Machine*, Alloyd Co., Inc., 2–page brochure, 2000, USA.
*Eight–Station Blister Packaging Machine*, Alloyd Co., Inc., 2–page brochure, 2000, USA.

* cited by examiner

*Primary Examiner*—John Sipos
*Assistant Examiner*—Michelle Lopez
(74) *Attorney, Agent, or Firm*—Burns, Doane, Swecker & Mathis, L.L.P.

(57) ABSTRACT

A blister packaging machine comprises a combination load/offload station having a blister magazine that is filled from the outside of the machine rather than the inside of the machine. The load mechanism includes a pick and place mechanism that is adapted to place individual blisters into nesting trays on a rotary carousel. The offload mechanism includes a pick and output mechanism that is adapted to pick formed blister packages from the nesting trays and output them into a collection bin. The load mechanism is arranged to cooperate with the offload mechanism without interference. The load and offload mechanism may be incorporated into a six station blister packaging machine.

28 Claims, 5 Drawing Sheets

58
54
60
56
72
74
34
34
64
68
66
50
70
62
64
34
88
46
90
86
84
40
46
52
80
78
28
92
26
76

ERGONOMIC BLISTER PACKAGING MACHINE

FIELD OF THE INVENTION

This invention pertains to packaging machines, and more particular to blister packaging machines where blisters packages are filled and fastened or sealed shut.

BACKGROUND OF THE INVENTION

Blister packages are used to individually package a variety of different products. Blister packages typically comprise two pieces which are referred to as a blister on one side (e.g. a plastic carton often having a formed cavity to receive product) and a card on the other side (e.g. a panel of plastic, cardboard, or other suitable material and which is often planar).

Blister packaging machines such as those made by Alloyd Co., Inc are used to fully or substantially automate the process of forming blister packages. Using a blister packaging machine, the steps for forming a blister package typically include placing a blister in a nesting tray, placing product into the cavity in the blister, placing a card on the blister, fastening the card to the blister to enclose the product, and then outputting formed blister packages off the machine.

The common implementation of a blister packaging machine comprises a rotary turntable that rotates individual nesting trays through different stations along an endless circular path. There are two different types of blister packaging machines that are commercially available, including a six station blister packaging machine such as Model 6SC1216 made and sold by Alloyd Co., Inc. and an eight station blister packaging machine such as Model 8SC 1216 made and sold by Alloyd Co., Inc. Eight station blister packaging machines provide for more options and features for the blistering packaging process. However, to provide this additional room to accommodate additional features, eight station blister packaging machines have required a larger rotary turntable, which in turn requires a larger footprint in a manufacturing plant. Eight station machines also inherently include some extra expense to provide additional features and options.

Due to these space and cost drawbacks, many manufacturers often will purchase and employ six station blister packaging machines. In six station blister packaging machines, the available space is a lot tighter and it is more difficult to accomplish the necessary blister packaging operations on a single machine. As a result, some operations such as offloading formed blister packages from nesting trays and loading new blisters into nesting trays are performed at the same station. Because the formed blister packages are output off the rotary turntable to the outside of the machine, the blister packaging offloading operation and components are provided at the outside of the machine. As a result, the blister loading operation is performed at the inside of the machine. With this arrangement, the blister magazine, which holds individual blisters, is positioned on the inside of the machine toward the center of the turntable. Unfortunately, this requires workers to load the magazine from the inside of the machine. Therefore, temporary shutdown of the machine may be needed to refill the magazine. Further, because the load end of the magazine is facing toward the inside of the machine, this requires workers to lean over the rotary turntable to fill the blister magazine. These drawbacks have long existed without a suitable solution.

BRIEF SUMMARY

One embodiment of the invention provides a blister packaging machine with a load and offload mechanism at the same station that allows for easier filling of the blister magazine from the outside of the machine rather than from the inside of the machine.

An embodiment of the present invention is directed toward a blister packaging machine of the type that comprises a rotary turntable having a plurality of nesting trays arranged around the rotary turntable that are adapted to receive individual blisters. A plurality of stations are arranged around the turntable such as product filling stations for placing product into the blisters. A card placing mechanism is arranged at one of the stations downstream of the product filling stations to place a card on the blister. A fasten mechanism fastens and may seal the placed card to the blister to form a blister package.

In accordance with an embodiment of the present invention, a blister magazine projects radially outward from a pick end toward a load end such that the magazine can be filled from the outside of the machine. Blisters are picked from the magazine at the pick end while blisters can be loaded into the magazine from the outside of the rotary turntable at the load end. A load mechanism includes a first pick head carried upon a first pivot body. The first pivot body moves about a first pivot axis between a first pick position proximate the pick end and a second offload position proximate a proximate one of the nesting trays, such that movement of the load mechanism is adapted to transfer blisters from the magazine to the nesting trays. An offload mechanism is arranged at the same station as the load mechanism. The offload mechanism includes a second pick head carried upon a second pivot body. This second pivot body moves about a second pivot axis between a second pick position proximate the proximate one of the nesting trays and an offload location radially outward of the rotary turntable for outputting formed blister packages from the machine.

Other aspects, objectives and advantages of the invention will become more apparent from the following detailed description when taken in conjunction with the accompanying drawings.

DETAILED DESCRIPTION OF THE INVENTION

Figure 1:
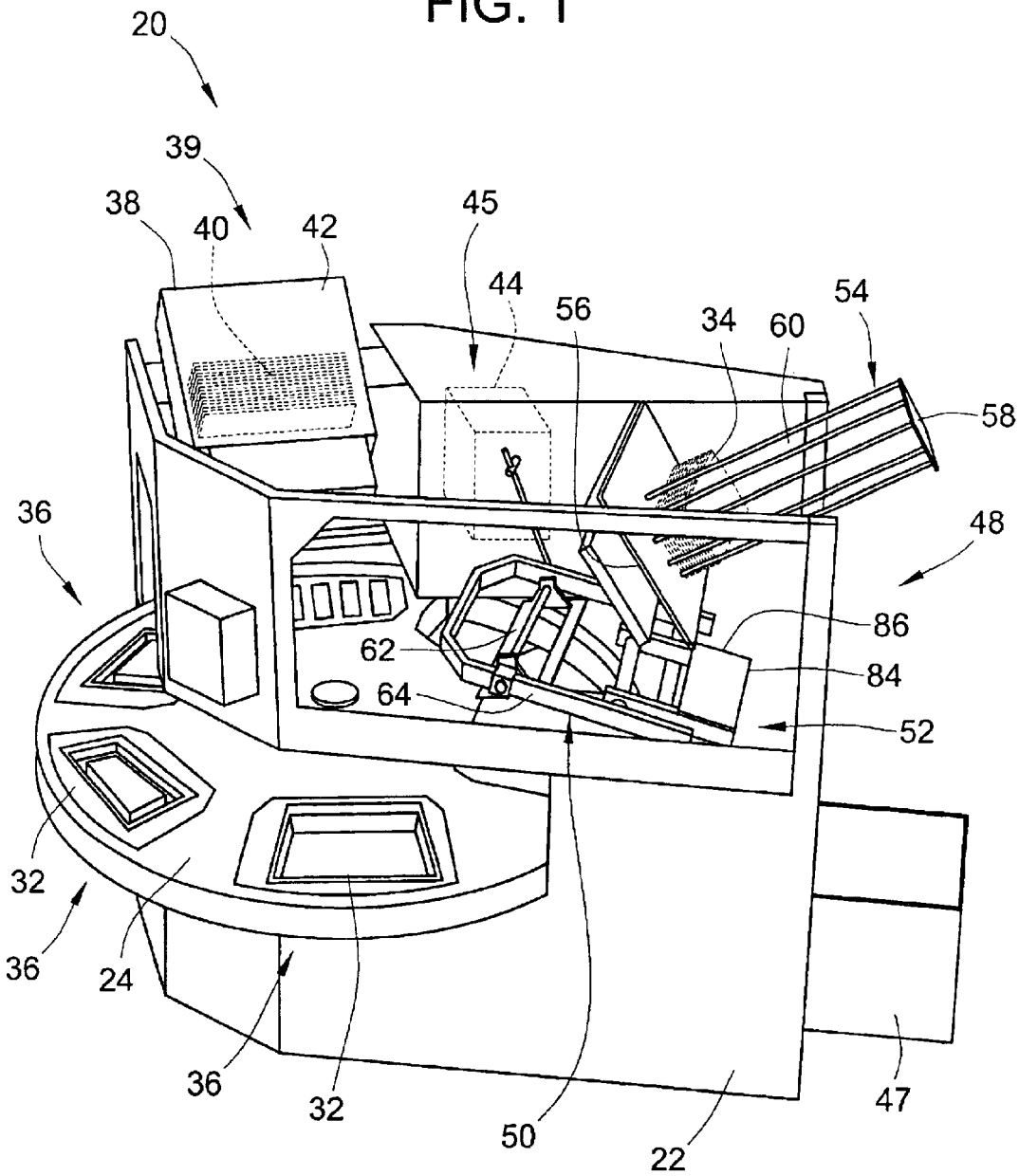
FIG. 1 is a perspective view of a blister packaging machine in accordance a preferred embodiment of the present invention.
Figure 2:
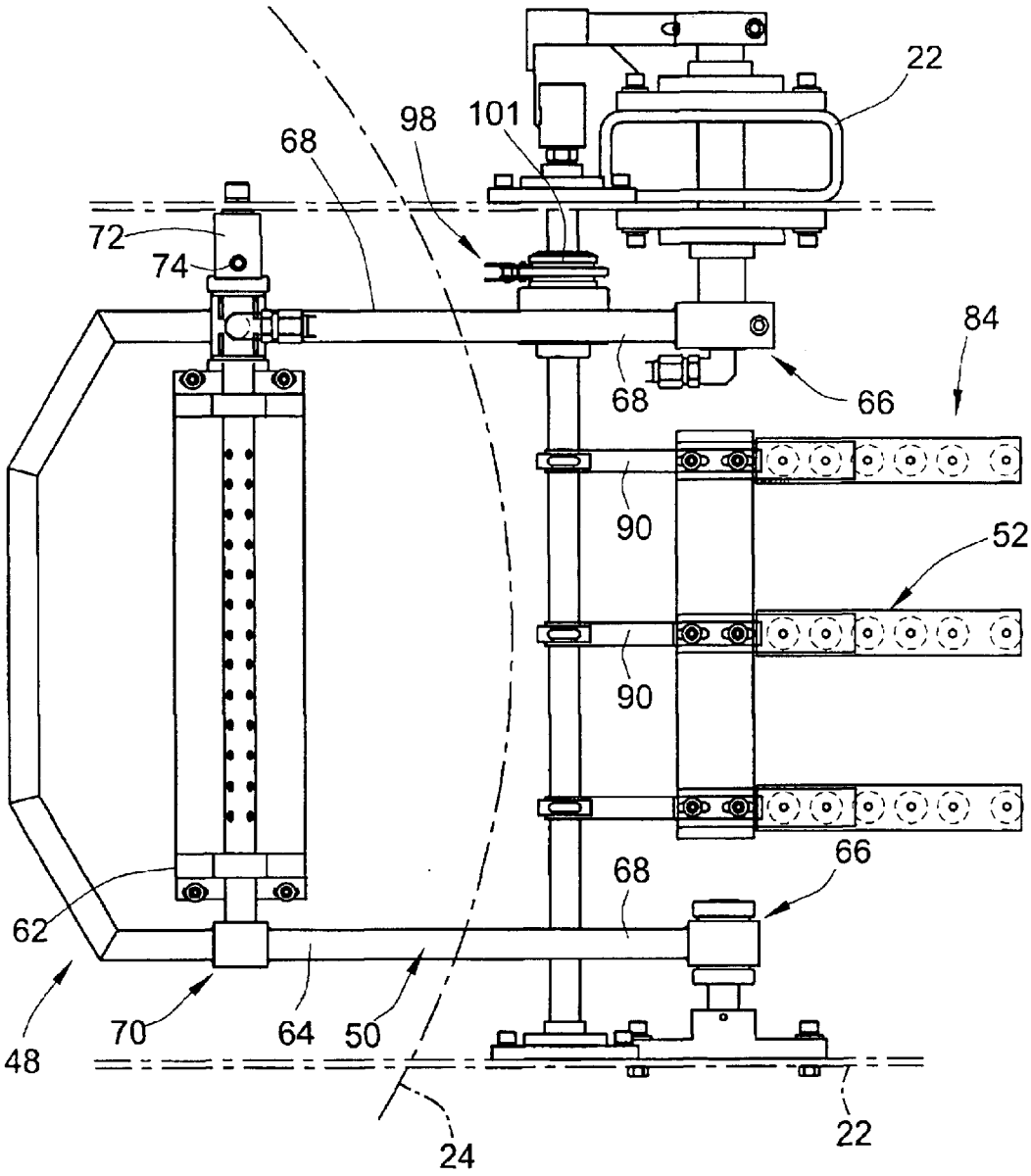
FIG. 2 is a top view of the load/offload mechanism used for the load/offload station of the blister packaging machine shown in FIG. 1.
Figure 3:
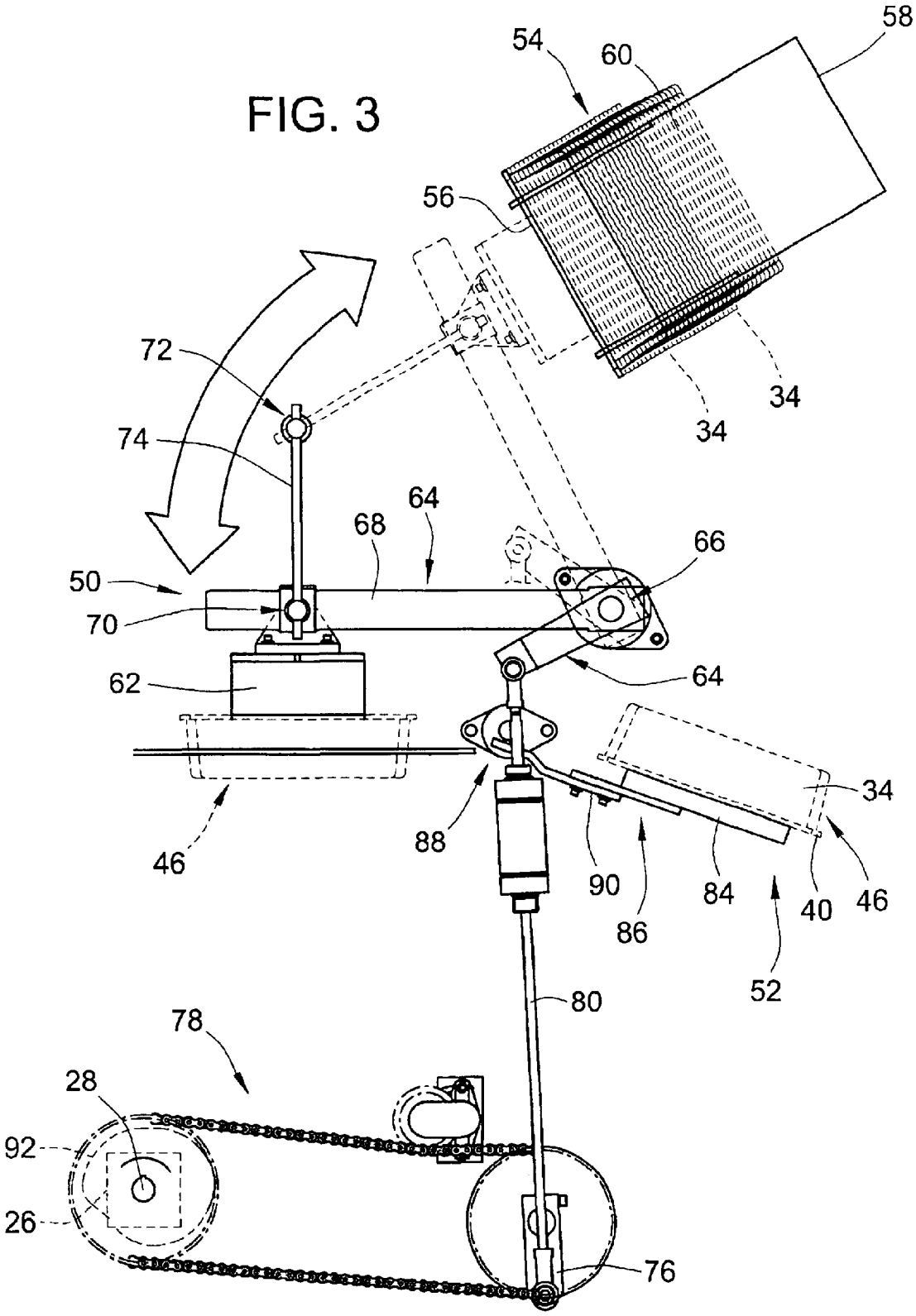
FIG. 3 is a side elevation view of the load/offload mechanism shown in FIG. 2 with dashed lines shown to indicate a cyclical range of movement.
Figure 4:
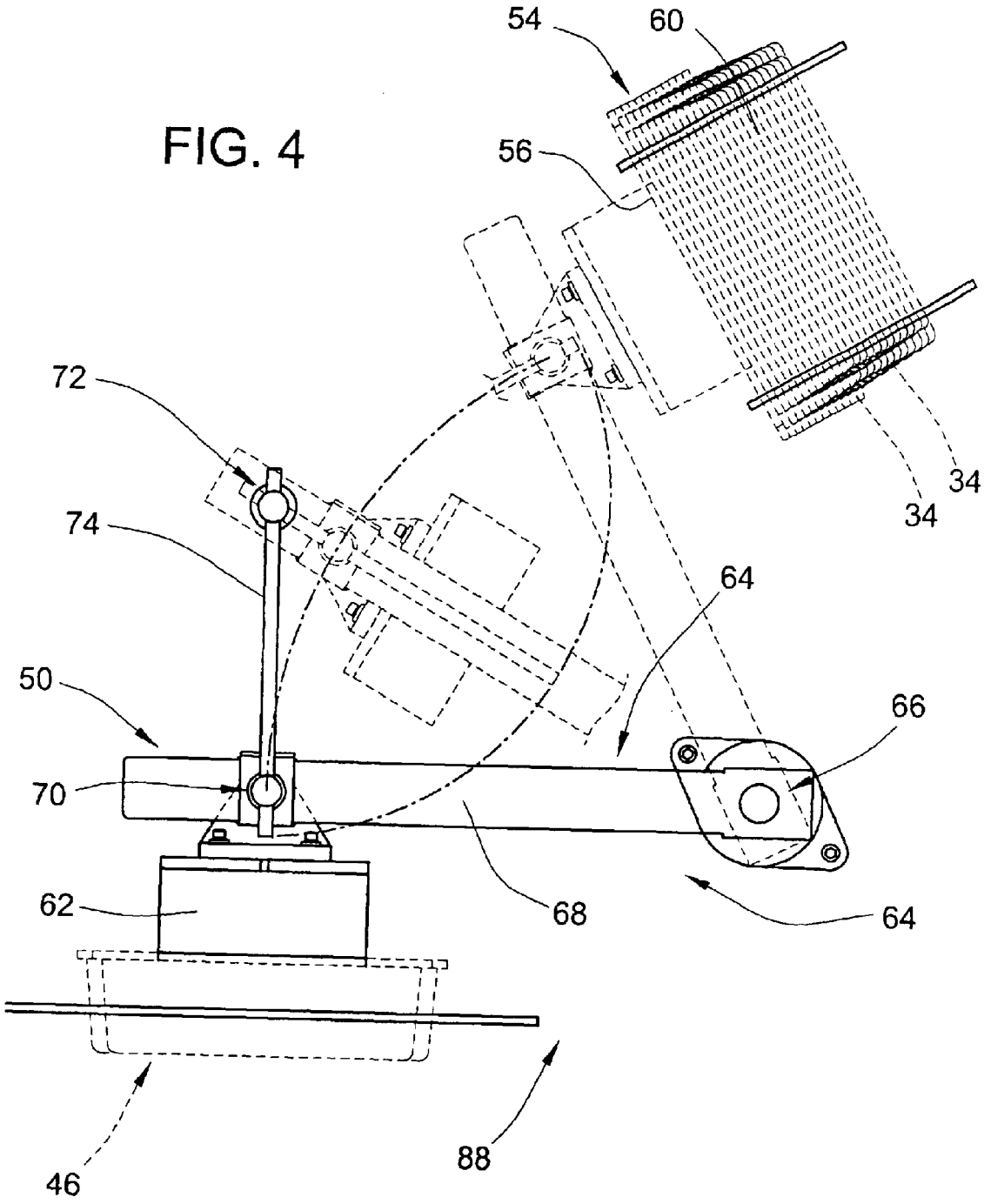
FIG. 4 is an enlarged side elevation of the blister load mechanism shown in FIG. 3 with dashed lines shown to indicate a cyclical range of movement.

Referring to FIG. 1, a preferred embodiment of the present invention is illustrated as a six station blister packaging machine 20. The invention is particularly suited and advantageous when applied to six station blister packaging machines, where available space is limited. As such a six station blister packaging machine 20 is shown, although it will be appreciated by one of ordinary skill in the art that the invention may be realized in blister packaging machines of other sizes.

Figure 5:
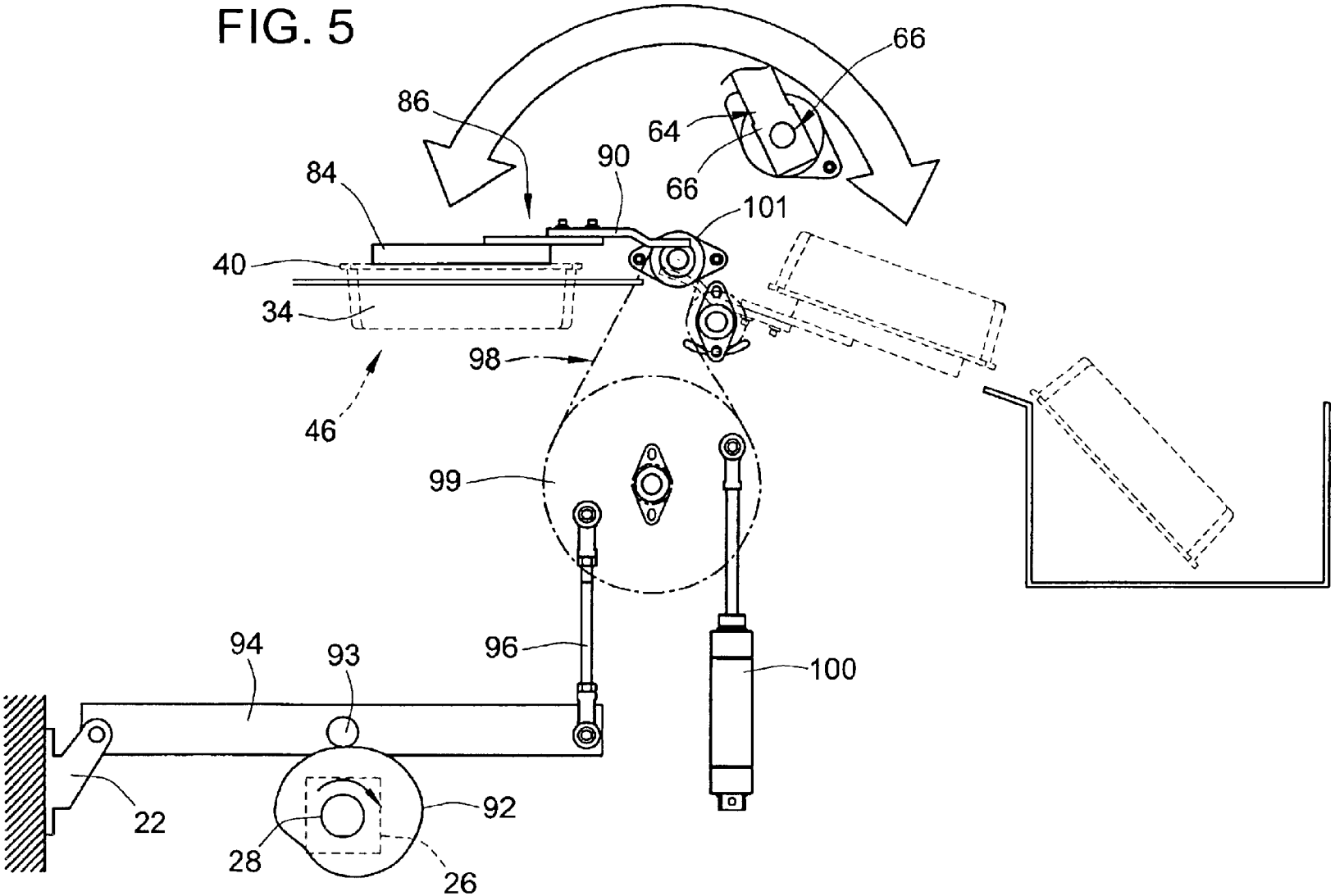
FIG. 5 is an enlarged side elevation of the blister package offload mechanism shown in FIG. 3 with dashed lines shown to indicate a cyclical range of movement.

The machine 20 includes a stationary support frame 22 and a rotary turntable 24. Referring to FIGS. 1 and 5, rotary actuator 26 supported by the frame 22 is provided for driving and rotating the rotary turntable 24 about a vertical axis relative to the frame 22. The rotary turntable 24 is connected through a mechanical timing mechanism (and more specifically an index mechanism) such as a geneva type drive to the output shaft 28 of the rotary actuator 26. When driven by the actuator 26, the geneva type drive indexes the rotary turntable 24 about the vertical axis at a predetermined frequency.

The rotary turntable 24 includes a plurality of nesting trays 32 mounted thereto that are spaced at equal angular intervals radially about the rotary turntable 24. The nesting trays 32 are configured to receive and support individual blisters 34. The number of nesting trays 32 depends upon the number of stations provided by the blister packaging machine 20. Because six stations are shown on the disclosed embodiment, six nesting trays 32 are mounted to the rotary turntable 24 such that one nesting tray 32 is disposed at each different station at any given time (other than when the machine is indexing positions).

The machine includes a plurality of stations arranged around the blister packaging machine 20. Three of the stations are product filling stations 36 where workers or machines can load or fill product into the cavities of blisters 34 situated in the nesting trays 32. Other stations provide for a card placing mechanism 38, a fasten mechanism 44, a blister load mechanism 50 and a blister package offload mechanism 52.

The card placing mechanism 38 is arranged downstream of the product filling stations 36. The card placing mechanism 38 operates to pick cards 40 from a card magazine 42 and places the cards 40 over the top of the blister 34 to enclose the product inside the cavity of the blister 34. The card placing mechanism 38 may be arranged at its own station 39 as is shown, immediately downstream of the product filling stations 36.

The fasten mechanism 44 such as a hot seal press or other suitable mechanism (the actual fasten mechanism used depends upon the type of blisters and cards used) is also arranged downstream of the product filling stations 36. The fasten mechanism 44 is adapted to secure the card 40 to the blister 34 to form the blister package 46. In the disclosed embodiment, the fasten mechanism 44 is disposed at its own station 45 immediately downstream of the card placing station 39.

A combination load/offload station 48 is arranged downstream of the product filling stations 36. Because the rotary turntable 24 provides an endless circular path, this station 48 is at the end of the blister packaging process for a formed blister package 46 and is also simultaneously at the beginning of the blister packaging process for a new blister 34. The load/offload station 48 comprises a load mechanism 50 adapted to load blisters 34 into the nesting trays 32. The load/offload station 48 also comprises an offload mechanism 52 adapted to offload completed blister packages 46 from the nesting trays 32 into a collection bin 47. Therefore, two different machine operations are performed at a single station on the machine.

To facilitate loading of new blisters 34 into the nesting trays, the load/offload station 48 also includes a blister magazine 54 that is adapted to hold blisters 34 in a ready pick position. In accordance with an embodiment of the present invention, the blister magazine 54 projects radially outward from a pick end 56 toward a load end 58. The pick end 56 of the blister magazine 54 presents individual blisters 34 to the load mechanism 50 for a pick and placement operation. The load mechanism 50 is operable to pick blisters 34 and place the blisters 34 in the nesting trays 32.

The load end 58 of the magazine 54 provides an entrance to the blister receptacle of the magazine 54 that holds blisters 34. Advantageously, the load end 58 is strategically arranged in a more ergonomic location, in which the load end 58 faces toward the outside of the machine rather than the inside of the machine. The load end 58 is also outboard of the rotary turntable 24. With this arrangement, the load end 58 can be readily reached for manual reloading without bending over the rotary turntable 24 and without having to shutoff the machine 20. As blisters 34 contained the blister magazine 54 are depleted, a worker can easily fill new blisters 34 into the blister magazine 54 without having to shut down the machine with greater comfort and ease. The blisters 34 naturally slide down via gravity from the load end 58 toward the pick end 56.

The load mechanism 50 and offload mechanism 52 are structurally configured and arranged to work one inside of the other to provide clearance for the novel and improved ergonomic orientation of the blister magazine 54. By working one inside of the other and with controlled movements, the movements of the load mechanism 50 and offload mechanism 52 do not interfere with each other while at the same time providing both blister loading and blister package offloading functions at the same station.

Referring to FIGS. 1–4, the load mechanism 50 comprises a pick head 62. The pick head 62 may include a vacuum or suction device or other suitable gripping device such that the pick head 62 is operable to pick, hold and then release blisters 34. The pick head 62 is carried upon a pivot body 64 that is pivotally mounted to the frame 22 via a hinge 66 (e.g. a pair of spaced stub shafts and bushing mounts) for pivoting movement about horizontal pivot axis about the hinge 66. The pivot body 64 includes a pair of laterally spaced pivot arms 68. The pivot arms 68 are pivotally supported by the hinge 66 at one end and pivotally support the pick head 62 perpendicularly between arms 68 at the other end. The arms 68 provide a second hinge 70 that pivotally supports the pick head 62 such that the pick head 62 can pivot or rotate relative to the arms 68.

During operation, the pick head 62 is pivoted to place the front end (the suction end) of the pick head 62 toward the pick end 56 of the blister magazine 54 to pick new blisters. The pick head 62 is also pivoted the reverse direction to place the front end of the pick head 62 toward the nesting tray 32 (disposed at the load/offload station during a cycle) to drop. individual blisters 34 into the nesting trays 32. In a preferred embodiment, this is accomplished automatically as the pivot arms 68 cyclically oscillate back and forth between the blister magazine 54 and the nesting trays 32. More specifically, a third stationary hinge 72 mounted on the frame 22 defines a further pivot axis that pivotally supports a guide arm 74 at one end. At the other end, the guide arm 74 acts on the pick head 62 through a linear slide bushing such that the guide arm 74 is slidably mounted to the pick head 62. During rotation of the pivot arms 68 between pick and load positions (see FIG. 3), the guide arm 74 automatically acts upon the pick head 62 to automatically pivot the pick head 62 toward the nesting trays 32 when proximate thereto and the pick end 56 of the blister magazine 54 when proximate thereto.

Advantageously, the pick head 62 and pivot arms 68 of the load mechanism 50 are driven by the same actuator 26 and by the same shaft 28 that drives the geneva type drive. As illustrated, the movement of the pick head 62 and pivot arms 68 are mechanically linked through a timing mechanism to the actuator mechanism 26 that drives the rotary turntable 24 such that the pivoting movements of the pick head 62 are synchronized with the indexing movement of the rotary turntable 24. Referring to the timing and actuating transmission mechanisms, the pivot arms 68 are driven by a crank arm 76 which is driven by a endless chain gear train 78 (1:1 gear ratio) by the output shaft 28 to offset the crank arm 76 from the output shaft 28. A vertically extending actuation rod 80 that is pivotally connected to the crank 76 at one end and the pivot body 64 at the other end. The crank 76 vertically drives the actuation rod 80 upwardly and downwardly to convert rotary motion to linear motion. This also cyclically accelerates and decelerates the pick head 62 with the pick head coming to a virtual stop at the ends of the oscillating movement (i.e. the moving speed of the pick head 62 generally follows a SIN wave). As a result, the pick head 62 is operable to pick a new blister 34 and drop off a formed blister package 46 when at a virtual standstill position.

The offload mechanism 52 includes a second pick head 84. The second pick head 84 may include a vacuum or suction device or other suitable gripping device such that the pick head 84 is operable to pick, hold and then release formed blister packages 46. This pick head 84 is carried upon another pivot body 86 that is pivotally mounted to the frame 22 via a hinge 88 (e.g. a shaft extending horizontally between a pair of bushing mounts) for pivoting movement about horizontal pivot axis about the hinge 88. The hinge 88 for the second pivot body 86 may be located below the hinge 66 of the first pivot body 64. The second pivot body 86 includes a plurality of extension arms 90 that are spaced between the laterally spaced pivot arms 68 of the first pivot body 64, such that the second pick head 84 and pivot body 86 can work inside of the first pivot body 64 without contact or interference.

The movement of the second pivot body 86 and pick head 84 are shown in FIGS. 1–3, 5. As illustrated, the second pivot body 86 and pick head 84 are driven by the same actuator 26 and by the same shaft 28 that drives the geneva type drive. As is also illustrated, the movement of the second pivot body 86 and pick head 84 are mechanically linked through a timing mechanism to the actuator mechanism 26 that drives the rotary turntable 24 such that the oscillating movement of the pick head 84 is synchronized with the indexing movement of the rotary turntable 24. Referring to the timing and actuating transmission mechanisms as shown in FIG. 5, a cam 92 is mounted to the output shaft 28 and is thereby driven by the actuating mechanism 26. The cam 92 drives a follower 93 which is mounted to a lever 94. One end of the lever 94 is pivotally mounted to the frame 22 while the other end is pivotally mounted to a vertically extending actuation rod 96. The actuation rod 96 is pivotally mounted to a sprocket 99 of a chain gear train assembly 98 and works against a spring or pneumatic shock absorber 100 or other suitable device that provides a counterforce that acts on an opposing side of the sprocket 99. The gear train assembly 98 also includes a sprocket 101 mounted to the shaft of the pivoted body 86. As the output shaft 28 of the actuating mechanism 26 rotates, the lever is driven upward by the cam 92 and then downward by the pneumatic shock absorber 100 (and/or weight of the assembly), such that the resulting motion is a cyclically oscillating motion of the pick head 84 of the second pivot body 86 between pick and offload positions. The shape of the cam 92 dictates the acceleration and deceleration of the second pick head 84. Preferably, the second pick head 84 is at a virtual standstill position when picking formed blister packages 46 to ensure proper picking of blister packages. If desired, the pick head 84 can release the blister packages on the move as placement is not of particular importance, as formed blister packages are simply offloaded into a collection bin 47.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to he construed to cover both the singular and the plural, unless otherwise indicated herein or clearly contradicted by context. The terms "comprising," "having," "including," and "containing" are to be construed as open-ended terms (i.e. meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate a preferred embodiment of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A blister packaging machine for packing product between a blister and a card to form a blister package, comprising:

a rotary turntable having a plurality of nesting trays arranged around the rotary turntable, the nesting trays adapted to receive blisters;

a plurality of stations positioned around the turntable including a plurality of product filling stations for placing product into the blister;

a card placing mechanism arranged at one of the stations downstream of the product filling stations, the card placing mechanism adapted to place a card on the blister;

a fasten mechanism arranged at one of the stations downstream of the product filling stations, the fasten mechanism adapted to fasten the card to the blister to form the blister package;

a blister magazine projecting radially outward from a pick end toward a load end, wherein blisters are adapted to be picked from the magazine at the pick end and wherein blisters are adapted to be loaded into the magazine from the outside of the rotary turntable at the load end;

a load mechanism arranged at one of the stations, the load mechanism comprising a first pivot body and a first pick head, the first pick head carried upon the first pivot body, the first pivot body moving about a first pivot axis between a first pick position proximate the pick end and a second offload position proximate a proximate one of the nesting trays, wherein movement of the load mechanism is adapted to transfer blisters from the magazine to the nesting trays; and an offload mechanism arranged at the same station as the load mechanism, the offload mechanism including a second pick head carried upon a second pivot body, the second pivot body moving about a second pivot axis between a second pick position proximate the proximate one of the nesting trays and an offload location radially outward of the rotary turntable.

2. The blister packaging machine of claim 1, wherein the first pivot body includes first pivot arms that are laterally spaced apart, and wherein the second pivot body includes second pivot arms that are laterally spaced apart, the second pivot arms carrying the second pick head between the first pivot arms.

3. The blister packaging machine of claim 2, further comprising a first mechanical timing mechanism connecting the first pivot body to an actuator mechanism and a second timing mechanism connecting the second pivot body to the actuator mechanism, the first and second mechanical timing mechanisms being synchronized to prevent interference between the load and offload mechanisms.

4. The blister packaging machine of claim 2, wherein the first pick head is pivotably connected to first pivot body between the first pivot arms at a third pivot axis, the first pick head pivoting relative to the pivot arms about the third pivot axis between the pick position wherein the first pick head faces the magazine and the load position wherein the first pick head faces one of the nesting trays.

5. The blister packaging machine of claim 4, further comprising a guide arm having one end slidably mounted to the first pick head for linear sliding movement and another end pivotably supported by a stationary pivot point, wherein rotation of the first pivot arms causes the first pick head to rotate about the stationary pivot point.

6. The blister packaging machine of claim 1 wherein said plurality of stations comprises only six stations.

7. The blister packaging machine of claim 1, wherein the card is a panel of plastic or cardboard.

8. A blister packaging machine for packing product between a blister and a card to form a blister package, comprising:

a stationary frame adapted to rest upon a plant floor;

a rotary turntable rotatably mounted to the stationary frame for rotation about a vertically extending first axis, the rotary turntable having a plurality of nesting trays adapted to receive blisters, the nesting trays being arranged radially about the axis in a spaced angular array;

an actuator mechanism adapted to rotatably index the rotary turntable about the first axis;

a plurality of stations around the turntable including product filling stations for placing product into the blister;

a card placing mechanism arranged at one of the stations downstream of the product filling stations, the card placing mechanism adapted to place a card on the blister;

a fasten mechanism arranged at one of the stations downstream of the product filling stations, the fasten mechanism adapted to fasten the card to the blister to form the blister package;

a combination load/offload station at one of the stations, comprising a load mechanism adapted to load blisters into the nesting trays, an offload mechanism adapted to offload blister packages from the nesting trays, and a blister magazine adapted to hold blisters;

the blister magazine projecting radially outward from a pick end toward a load end, wherein blisters are adapted to be picked from the magazine at the pick end and wherein blisters are adapted to be loaded into the magazine from the outside of the rotary turntable at the load end;

the load mechanism comprising a first pick head carried upon a first pivot body, the actuator mechanism driving the first pivot body about a first pivot axis between a first pick position proximate the pick end and a load position proximate any one of the nesting trays disposed at the combination load/offload station, wherein movement of the load mechanism is adapted to transfer blisters from the magazine to the nesting trays; and the offload mechanism including a second pick head carried upon a second pivot body, actuator mechanism driving the second pivot body about a second pivot axis between a second pick position proximate any one of the nesting trays disposed at the combination load/offload station and an offload location radially outward of the rotary turntable.

9. The blister packaging machine of claim 8, wherein the first pivot body includes first pivot arms that are laterally spaced apart, and wherein the second pivot body includes second pivot arms that are laterally spaced apart, the second pivot arms carrying the second pick head between the first pivot arms.

10. The blister packaging machine of claim 9, further comprising a first mechanical timing mechanism connecting the first pivot body to the actuator mechanism and a second timing mechanism connecting the second pivot body to the actuator mechanism, the first and second mechanical timing mechanisms being synchronized to prevent interference between the load and offload mechanisms.

11. The blister packaging machine of claim 9, wherein the first pick head is pivotably connected to first pivot body between the first pivot arms at a third pivot axis, the first pick head pivoting relative to the pivot arms about the third pivot axis between the pick position wherein the first pick head faces the magazine and the load position wherein the first pick head faces one of the nesting trays.

12. The blister packaging machine of claim 11, further comprising a guide arm having one end slidably mounted to the first pick head for linear sliding movement and another end pivotably supported by a stationary pivot point, wherein rotation of the first pivot arms causes the first pick head to rotate about the stationary pivot point.

13. The blister packaging machine of claim 8 wherein said plurality of stations comprises only six stations.

14. The blister packaging machine of claim 13 wherein the plurality of product filling stations solely utilize three of the six stations, wherein the combination load/offload station solely utilizes one of the six stations, the card placing mechanism solely utilizes one of the six stations and the fasten mechanism solely utilizes one of the six stations.

15. The blister packaging machine of claim 8, wherein the card is a panel of plastic or cardboard.

16. A blister packaging machine for packing product between a blister and a card to form a blister package, the blister packaging machine comprising:

a rotary turntable having a plurality of nesting trays arranged around the rotary turntable, the nesting trays adapted to receive blisters;

a plurality of stations positioned around the turntable including at least one product filling station for placing product into the blisters;

a card placing mechanism arranged at one of the stations downstream of the product filling stations, the card placing mechanism adapted to place a card on each of the blisters;

a fasten mechanism arranged at one of the stations downstream of the product filling station, the fasten mechanism adapted to fasten the card to the blister to form the blister package;

a blister magazine projecting radially outward from a pick end toward a load end, wherein blisters are adapted to be picked from the magazine at the pick end and wherein blisters are adapted to be loaded into the magazine from outside of the rotary turntable at the load end;

a load mechanism arranged at one of the stations, the load mechanism comprising a first pick head carried upon a first body, the first body moving between a first pick position proximate the pick end and a second offload position proximate a proximate one of the nesting trays, wherein movement of the load mechanism is adapted to transfer blisters from the magazine to the nesting trays; and an offload mechanism arranged at the same station as the load mechanism, the offload mechanism including a second pick head carried upon a second body, the second body moving between a second pick position proximate the proximate one of the nesting trays and an offload location radially outward of the rotary turntable.

17. The blister packaging machine of claim 16, wherein the first body includes first pivot arms that are laterally spaced apart, and wherein the second body includes second pivot arms that are laterally spaced apart, the second pivot arms carrying the second pick head between the first pivot arms.

18. The blister packaging machine of claim 17, further comprising a first mechanical timing mechanism connecting the first body to an actuator mechanism and a second timing mechanism connecting the second body to the actuator mechanism, the first and second mechanical timing mechanisms being synchronized to prevent interference between the load and offload mechanisms.

19. The blister packaging machine of claim 16 wherein said plurality of stations comprises six stations.

20. The blister packaging machine of claim 16, wherein the card is a panel of plastic or cardboard.

21. A blister packaging machine for packing product between a blister and a card to form a blister package, the blister packaging machine comprising:

a stationary frame adapted to rest upon a plant floor;

a rotary turntable rotatably mounted to the stationary frame for rotation about a vertically extending first axis, the rotary turntable having a plurality of nesting trays adapted to receive blisters, the nesting trays being arranged radially about the axis in a spaced angular array;

an actuator mechanism adapted to rotatably index the rotary turntable about the first axis;

a plurality of stations around the turntable including at least one product filling station for placing product into the blister;

a card placing mechanism arranged at one of the stations downstream of the product filling station, the card placing mechanism adapted to place a card on the blister;

a fasten mechanism arranged at one of the stations downstream of the product filling station, the fasten mechanism adapted to fasten the card to the blister to form the blister package;

a combination load/offload station at one of the stations, comprising a load mechanism adapted to load blisters into the nesting trays, an offload mechanism adapted to offload blister packages from the nesting trays, and a blister magazine adapted to hold blisters;

the blister magazine projecting radially outward from a pick end toward a load end, wherein blisters are adapted to be picked from the magazine at the pick end and wherein blisters are adapted to be loaded into the magazine from outside of the rotary turntable at the load end;

the load mechanism comprising a first pick head carried upon a first body, the actuator mechanism driving the first body between a first pick position proximate the pick end and a load position proximate any one of the nesting trays disposed at the combination load/offload station, wherein movement of the load mechanism is adapted to transfer blisters from the magazine to the nesting trays; and the offload mechanism including a second pick head carried upon a second body, the actuator mechanism driving the second body between a second pick position proximate any one of the nesting trays disposed at the combination load/offload station and an offload location radially outward of the rotary turntable.

22. The blister packaging machine of claim 21, wherein the first body includes first pivot arms that are laterally spaced apart, and wherein the second body includes second pivot arms that are laterally spaced apart, the second pivot arms carrying the second pick head between the first pivot arms.

23. The blister packaging machine of claim 22, further comprising a first mechanical timing mechanism connecting the first body to the actuator mechanism and a second timing mechanism connecting the second body to the actuator mechanism, the first and second mechanical timing mechanisms being synchronized to prevent interference between the load and offload mechanisms.

24. The blister packaging machine of claim 21, wherein the first pick head is pivotably connected to first pivot body between the first pivot arms at a third pivot axis, the first pick head pivoting relative to the pivot arms about the third pivot axis between the pick position wherein the first pick head faces the magazine and the load position wherein the first pick head faces one of the nesting trays.

25. The blister packaging machine of claim 24, further comprising a guide arm having one end slidably mounted to the first pick head for linear sliding movement and another end pivotably supported by a stationary pivot point, wherein rotation of the first pivot arms causes the first pick head to rotate about the stationary pivot point.

26. The blister packaging machine of claim 21 wherein said plurality of stations comprises only six stations.

27. The blister packaging machine of claim 26 wherein the plurality of product filling stations solely utilize three of the six stations, wherein the combination load/offload station solely utilizes one of the six stations, the card placing mechanism solely utilizes one of the six stations and the fasten mechanism solely utilizes one of the six stations.

28. The blister packaging machine of claim 21, wherein the card is a panel of plastic or cardboard.

* * * * *